US005265757A

United States Patent [19]

Wu

[11] Patent Number: 5,265,757

[45] Date of Patent: Nov. 30, 1993

[54] CONTAINER WITH SUCKING TUBE

[75] Inventor: Hua-Te Wu, Tainan, Taiwan

[73] Assignee: Yienn Lih Enterprise Co., Ltd., Tainan, Taiwan

[21] Appl. No.: 953,858

[22] Filed: Sep. 30, 1992

[51] Int. Cl.[5] ..... B65D 47/12

[52] U.S. Cl. ..... 220/707; 220/708; 220/709

[58] Field of Search ..... 220/705, 707, 708, 709; 215/1 A, 11.1; 229/103.1

[56] References Cited

U.S. PATENT DOCUMENTS

| | | | |
|---|---|---|---|
| 2,025,508 | 12/1935 | Herstein | 215/11.1 |
| 2,760,664 | 8/1956 | D'Amico et al. | 215/11.1 |
| 2,812,764 | 11/1957 | Crisp | 215/11.1 |
| 4,485,963 | 12/1984 | Panicci | 215/1 A X |
| 4,898,290 | 2/1990 | Cueto | 215/11.1 |
| 4,994,076 | 2/1991 | Guss | 215/11.1 X |
| 5,150,815 | 9/1992 | Saklad | 220/708 |

*Primary Examiner*—Stephen Garbe
*Assistant Examiner*—Stephen Cronin
*Attorney, Agent, or Firm*—Morton J. Rosenberg; David I. Klein

[57] ABSTRACT

A container with a sucking tube comprising a tubular post vertically passing through a cap covered on a container body, an inverted T-shaped short tube fixed on the top of the tubular post, an soft upper sucking tube forcefully fitted around the inverted T-shaped tube and protruding upward through an opening in a protective cap covered on the cap for sucking, a nut-like member inserted through the upper sucking tube to screw with a thread in the tubular post to secure the upper sucking tube tightly in place.

1 Claim, 2 Drawing Sheets

CONTAINER WITH SUCKING TUBE

BACKGROUND OF THE INVENTION

A conventional contrainer with a sucking tube shown in FIG. 3 comprises a container body 1, a cap 2 capped on top of the container body 1, a tubular post 21 vertically passing through the cap 2 to extend in the container body 1, an upper sucking tube 211 connected with an upper end of the tubular post 21, a lower sucking tube 212 connected with a lower end of the tubular post 21 and a protective cap 3 covered on the cap 2. The protective cap 3 has an opening 31 for the soft upper sucking tube 211 to protrude through upward for a yound child to suck. When this container with a sucking tube is not used, the protective cap 3 is rotated a little, forcing the soft sucking tube 211 to be pressed down by a wall around the opening 31 of the protective cap 3 to hide therein.

This kind of container with a sucking tube is considered to have disadvantages as listed below.

1. As the upper soft sucking tube generally made of flexible plastics is connected with the tubular post by means of fitting around an upper end of the tubular post, it may be separated from the tubular post, in case it is playfully pulled with excessive force by a child or it has been used for a long period of time. 2. The upper soft sucking tube might be swallowed or lost by a careless child in case it should be separated from the tubular post.

SUMMARY OF THE INVENTION

This invention has been devised to improve the above-mentioned conventional container with a sucking tube, aiming to have advantages as follow.

1. It has a hygienic and hiding structure for an upper sucking tube, wheerein a protective cap is rotated a little, letting an opening therein press down the sucking tube to hide in the protective cap in case it is not used, and the opening moves to be located just above an inverted L-shaped plate as if it were indirectly closed, preventing exterior dirty matters from contaminating the sucking tube.

2. The upper sucking tube is first fitted fixedly around an inverted T-shaped short tube on a tubular tube and then covered securely by a nut-like member on the connecting point, so it cannot be easily pulled off or loosened off after a long period of use.

BRIEF DESCRIPTION OF DRAWINGS

The invention will be better understood by reference to the accompanying drawings, wherein.

DETAILED DESCRIPTION OF THE INVENTION

Figure 1:
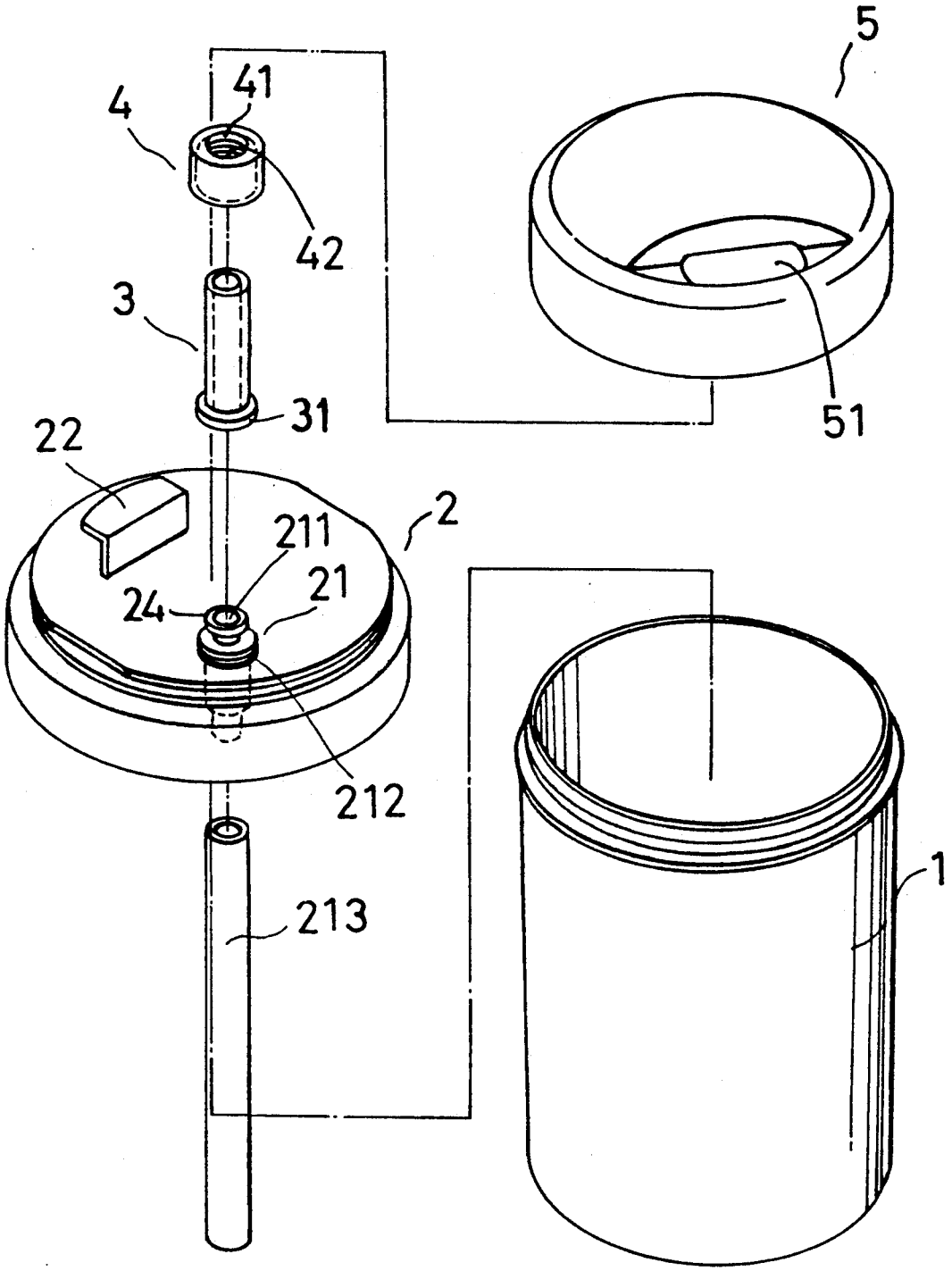
FIG. 1 is an exploded perspective view of a container with a sucking tube in the present invention.
Figure 3:
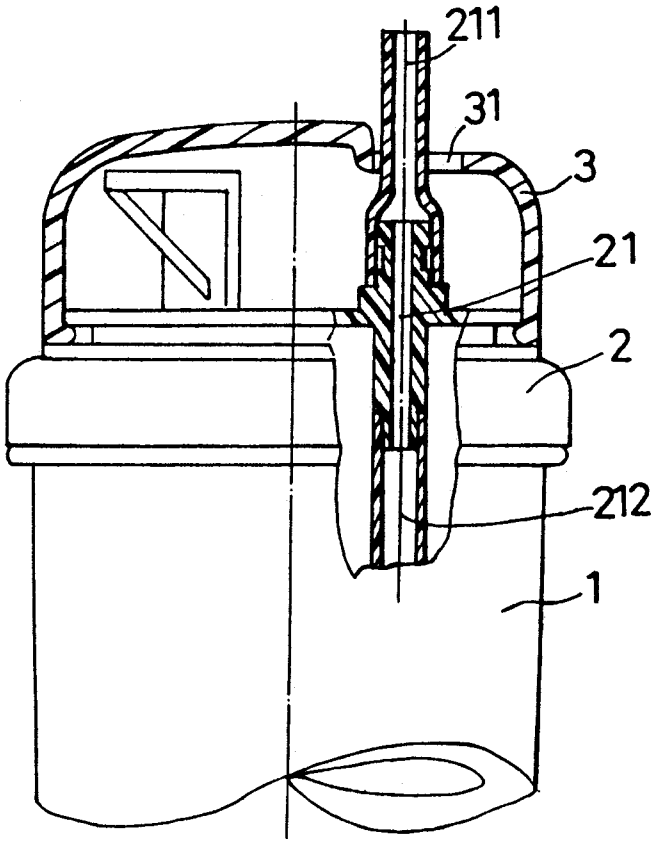
FIG. 3 (PRIOR ART)

A container with a sucking tube in the present invention, as shown in FIG. 1, comprises a container body 1, a cap 2, a tube 3, a nut-like member 4, and a protective cap 5 as main components.

The container body 1 is preferably shaped cylindrical for containing a liquid drink, having an upper opening to be capped with the cap 2 and a thread around an upper end to engage with the cap 2.

The cap 2 has a thread to engage the thread of the container body 1, a tubular post 21 foxed to pass vertically through the cap 2 and having an inverted T-shaped short tube 211 fixed on its top, a threaded portion 212 under the tube 211, a lower end to fit with an upper end of a sucking tube 213 extending in the container body 1 and an inverted L-shaped plate 22 on an upper end surface.

The upper sucking tube 3 is provided to have its lower end formed with a flange 31 fitting around the inverted T-shaped tube 211 for sucking a drink contained in the container body 1. The upper flange 31 engages the lower flange or threaded portion 212 while the upper sucking tube 3 is forced around the upper flange 24 as shown in FIG. 2 in order to provide enhanced securement.

The nut-like member 4 has a central hole 41 and a female thread 42 in the hole surface and fitting around and passing down the upper sucking tube 3 to screw with the tubular post 21.

The protective cap 5 is to be covered on the cap 2, having an opening 51 for the upper sucking tube 3 to extend through upward.

Figure 2:
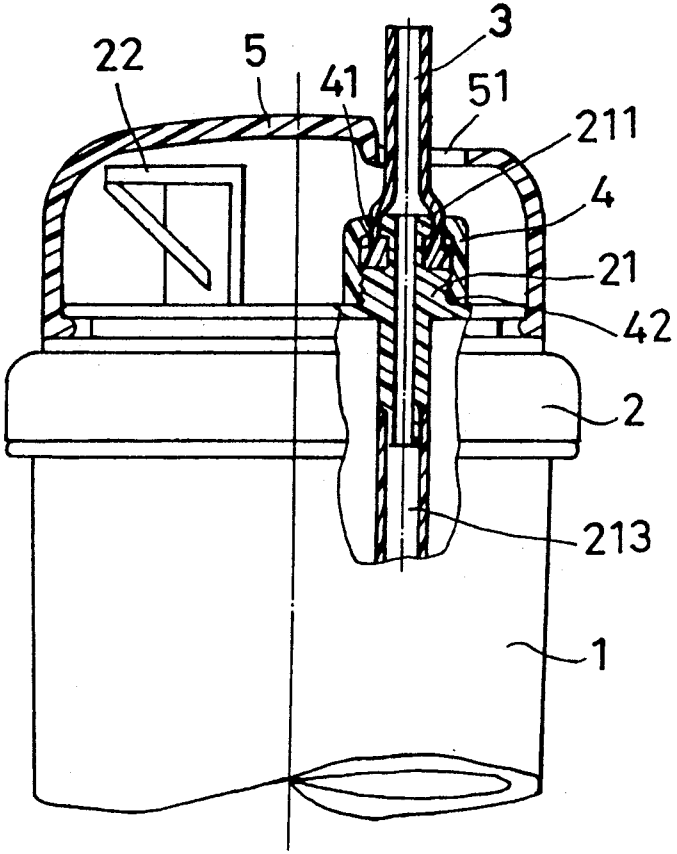
FIG. 2 is a cross-sectional view of the container with a sucking tube in the present invention; and, FIG. 3 is a cross-sectional view of a conventional container with a sucking tube.

In combining and using this container with sucking tube, as shown in FIG. 2, the upper sucking tube 3 is to be pressed down from upside to fit around the inverted T-shaped tube 211. Then the nut-like member 4 is fitted around and pushed down the tube 3 and then is rotated to have the thread 42 to screw with the thread 212 so as to fix a bottom end of the tube 3 securely with the inverted T-shaped tube 211. Next, the protective cap 5 is covered on the cap 2, with the tube 3 proturding through the opening 51 for a child to suck the tube 3. Lastly, the cap 2 is directly covered in the upeer opening of the container body 1, with the lower sucking tube 213 extending down in drink in the container body 1.

While the preferred embodiments of the invention have been described above, it will be recognized and understood that various claims are intended to cover all such modifications which may fall within the spirit and scope of the invention.

What is claimed is:

1. A container with a sucking tube comprising:

a cylindrically contoured container body having an upper opening threadedly secured to a threaded cap;

a tubular post vertically passing through the cap to extend internally into the container body, said tubular post defining a lower threaded flange located contiguous on an upper surface of said cap and an upper flange vertically displaced from said lower flange;

an inverted L-shaped plate secured to said upper surface of the cap;

a protective cap positionally covering said cap, having an opening for an upper sucking tube to protrude therethrough;

said upper sucking tube frictionally force fit around the upper flange on the tubular post and having a flange at a bottom section being fixedly secured to said lower flange by a mating nut member;

a lower sucking tube fluidly coupled to a lower end of the tubular post to extend to a bottom section of the container body;

said nut member having a central hole formed therethrough with a female thread, said nut member inserted around said upper sucking tube to threadedly engage the threaded portion of the tubular post for coupling the upper sucking tube with the tubular post;

said upper sucking tube protruding upward through said protective cap for sucking a liquid contained in the container body and maintaining said upper sucking tube in fixed securement to said tubular post.

* * * * *